United States Patent [19]

Nakayama et al.

[11] Patent Number: 4,719,896

[45] Date of Patent: Jan. 19, 1988

[54] CAPACITIVE DISCHARGE IGNITION DEVICE

[75] Inventors: Hitoshi Nakayama; Nobuo Miura, both of Wako; Yoshio Morita, Hidaka; Masami Kawabe, Yono, all of Japan

[73] Assignee: Honda Giken Kogyo K.K., Tokyo, Japan

[21] Appl. No.: 2,969

[22] Filed: Jan. 13, 1987

[30] Foreign Application Priority Data

Feb. 14, 1986 [JP] Japan ..... 61-29962

[51] Int. Cl.[4] ..... F02P 3/09

[52] U.S. Cl. ..... 123/599; 123/149 D

[58] Field of Search ..... 123/599, 600, 602, 149 C, 123/149 D

[56] References Cited

U.S. PATENT DOCUMENTS 4,478,200 10/1984 Nagashima et al. ..... 123/599 X
4,611,569 9/1986 Kondo et al. ..... 123/602 X

FOREIGN PATENT DOCUMENTS 183863 10/1983 Japan ..... 123/599
113260 6/1984 Japan ..... 123/599

*Primary Examiner*—Tony M. Argenbright
*Attorney, Agent, or Firm*—Lahive & Cockfield

[57] ABSTRACT

A capacitive discharge ignition system has first and second bypass elements. The bypass elements are controlled to effect equal charging from the positive and negative portions of the generator alternating power output, and to provide conductive paths for the ignition current outside the generator winding. This lessens current-induced generation of heat in the generator winding.

3 Claims, 8 Drawing Figures

CAPACITIVE DISCHARGE IGNITION DEVICE

GENERAL BACKGROUND

The present invention relates to a capacitive discharge ignition device, and more particularly to such a device which is adapted to lessen rise of temperature of a generator coil (exciter coil) of an engine.

As an ignition device of an engine for automobile, there have been used in the prior art a normal ignition device 1 shown in FIG. 3 and a voltage doubler ignition device 2 shown in FIG. 4. The normal ignition device 1 shown in FIG. 3 is adapted to charge a capacitor 4 for ignition with a positive power of a generator coil 6 which causes an alternating electric power by the rotation of the engine, and to discharge by a switching element while keeping the charge. Thus, the negative power of the generator coil is adapted to short circuit at a diode 8.

Also, the voltage doubler ignition device shown in FIG. 4 provides a second capacitor 12 which is charged by the negative power of the generator coil 6. The charging is made from the second capacitor 12 to a first capacitor 4 when inverting into the positive power. The ignition device is further charged with the positive power to obtain the double voltage and after charging, is adapted to bring the generator coil 6 to a short circuit condition by a regulator (+Reg) 14 for discharge through the switching element 16 ($SCR_1$) thereby to limit the power of the generator coil.

PROBLEMS TO BE SOLVED BY THE INVENTION

The present invention addresses generation of heat in the generator coil as a problem. Because the generator coil is positioned in the engine, it is subject to very high temperature due to heat generated from the engine and self-generation of heat due to a current which flows in the generator coil. Further, since the generator coil increases the resistance value of its turns with temperature, with the result the self-loss is increased, there has been a problem that the generator runs increasingly hot from the heat due to the self-loss, which drops also the generating efficiency. The high temperature has a tendency to cause an insulating material between the turns of the generator coil to be deteriorated and to cause its breakdown voltage and life time to be lowered. Since the generation of heat is proportional to the square of the current, a slight increase and decrease of the current run in the generator coil influences considerably the increase and decrease of the generation of heat, and therefore, a problem has been lodged to cause the current to be decreased.

The current of the generator coil 6 in the normal ignition device 1 as shown in FIG. 3 is such that, as shown in FIG. 5(*b*), the charging current $i_1$ to the capacitor 4 flows during the positive side of the power of the generator coil through a diode 7 and that the short circuit current $i_2$ flows during the negative side through the diode 8, the current being a large current deviated to the negative side by the imbalance between the positive and the negative sides due to half-wave rectification. As shown in FIG. 5(*c*), the current of the generator coil 6 in voltage doubler ignition device 2 as shown in FIG. 4 is such that the charging current $i_3$ is run to the second capacitor 12 during the negative side through the diode 9, and that the charging current $i_4$ is run to the first capacitor 4 for ignition from the second capacitor 12 at a start converted into the positive side. Since the capacitor 4 is almost charged here, most of the power of the positive side is short circuited at the regulator 12 (+Reg), the current being a large current deviated to the positive side for the same reason as mentioned above. Further, in this case, it has an inconvenience that the current increases more than the normal ignition device because the charging current runs through the generator coil. The generation of heat in the generator coil is determined by effective current which is expressed by the square mean of the area of each wave. The area is increased and decreased by deviation or offset position of 0 V (FIGS. 5, 6) and becomes minimum when 0 V is in the center of the sine wave (when the positive and the negative sides balance). For this reason, the prior ignition devices have had inconveniences that the effective current was large and that the generation of heat was large.

OBJECTS AND SUMMARY OF THE INVENTION

In order to solve the aforementioned problems and inconveniences, and object of the present invention to provide a capacitive discharge ignition device in which a generator coil is adapted to lessen its generation of heat by providing a high ignition voltage and by drawing a balance between the positive and the negative sides of the current in the generator coil so as to minimize the current.

To attain the object, the present invention proposes a capacitive discharge ignition device wherein alternating electric power generated by a generator coil is discharged to an ignition coil by a switching element after charging a first capacitor whereby an engine is ignited, characterized in that it provides first bypass means which charges a second capacitor during one half cycle of the alternate electric power and which brings said generator coil to a short circuit or substantially short circuit condition after charging and which charges said first capacitor from said second capacitor, and also second bypass means which charges said first capacitor from said generator coil during the other half cycle of the alternate electric power and which brings said generator coil to the short circuit or substantially short circuit condition.

In a preferred embodiment of the present invention the charging current to the capacitor is substantially uniform at the negative side which is one half cycle of the alternating electric power of the generator coil, and at the positive side which is the other half cycle, the negative and the positive sides being led to the short circuit or substantially short circuit condition. Accordingly, the current is balanced at the negative and the positive sides and becomes minimum. Further, the preferred embodiment incorporates a voltage doubler ignition circuit with a first capacitor and a second capacitor for ignition so that a high ignition voltage is obtained. Furthermore, the voltage doubler ignition circuit, when the second capacitor for ignition is charged by the electric charge from the first capacitor, the charging is carried out by forming a bypass using the bypass means, and as result, the charging current is not run in the generator coil differing from the prior circuit.

LISTING OF PARTS LABELLED IN FIGURES

EXT . . . Generator Coil
−Reg . . . Regulator (First bypass means)
+Reg . . . Regulator (Second bypass means)
Igc . . . Ignition coil
$C_0$ . . . Second capacitor
$C_1$ . . . First capacitor
$SCR_1$, $SCR_2$, $SCR_3$ . . . Thyristors

DETAILED DESCRIPTION OF ILLUSTRATED EMBODIMENTS

Figure 1:
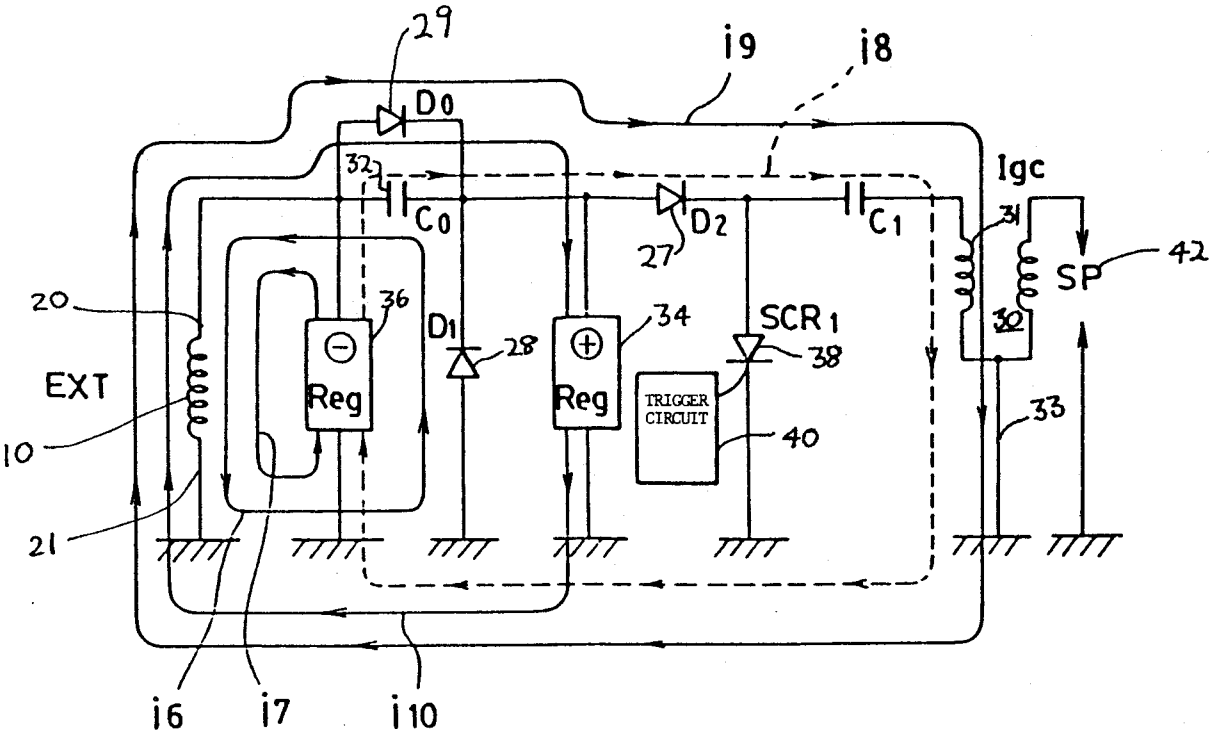
FIG. 1 is a circuit diagram showing one embodiment of the present invention.

An embodiment of the present invention will now be described below in detail referring to the attached drawings. FIG. 1 is a circuit diagram showing one embodiment of the present invention.

Firstly, description will be made for circuit structure. One end 20 of a generator coil 10 (EXT) inducing an alternating electric power with revolution of an engine is connected in series with a second capacitor 32, a diode 27 for rectification, and a first capacitor 24 for ignition and is connected with one end 31 of an ignition coil 30, the other ends (21, 33) of both the coils 10 and 30 being grounded to form a closed circuit. At both connecting points of the second capacitor 32 is connected in parallel a diode 29 forming a charging passage to the first capacitor 24 during the positive side of the said alternating electric power (referred to as the positive side hereinafter). In order that a charging passage to the second capacitor 24 is formed at a negative side of the alternate electric power cycle (referred to as the negative side hereinafter), a diode 28 is connected to the earth side at its anode terminal and to the connecting point of the second capacitor 32 and the diode 29 at its cathode terminal. Across both the connecting points of the generator coil 10 is connected a regulator (−Reg) 36 which is non-conducting at the positive side and which brings to a short circuit condition (it may be a substantially short circuit condition) at a certain timing when converting into the negative side. Also, the regulator (−Reg) 36 forms a charging passage from the second capacitor 32 to the first capacitor 24 leading from the second capacitor 32 to the diode 27 to the first capacitor 24 to the ignition coil 30 to the second capacitor 32 with the (−Reg) regulator 36 forming the second bypass means of the present invention. Between the connecting points of the diodes 29, 28, 27 and the ground sides is a regulator (+Reg) 34 which is not conductive at the negative side and which brings the generator coil 10 to a short circuit condition (it may be a substantially short circuit) through the intermediary of the diode 29 at a certain timing when converting into the positive side, the regulator 34 constituting the first bypass means. At the connecting point of the first capacitor 24 and the cathode of the diode 27 is connected a thyristor 38 which is a switching element conducting to the ground side. At the gate of the thyristor there is connected the output of a trigger circuit 40 which synchronizes with the revolution of the engine and which generates the GATE ON signal adapted to adjust the leading angle (i.e., spark advance) according to the number of revolutions of the engine. By the GATE ON signal, the thyristor becomes conductive and the electric charges of the first capacitor 24 flow in the ignition coil 30 whereby sparks are generated at an ignition plug (Sp) 42 by high voltage induced in the secondary side of the ignition coil 30 so as to ignite the engine.

Figure 5A:
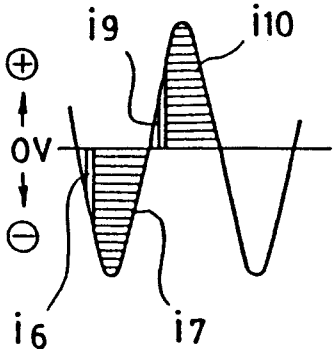
FIGS. 5(*a*), (*b*), (*c*) are wave form charts showing the current of-the generator coil in FIGS. 1, and 4, respectively.
Figure 5B:
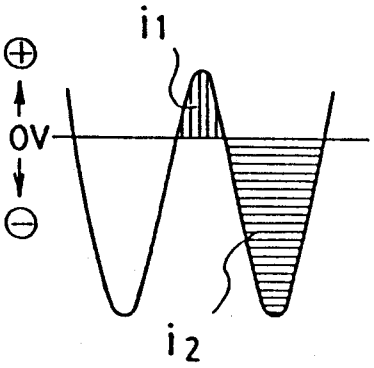
Figure 5C:
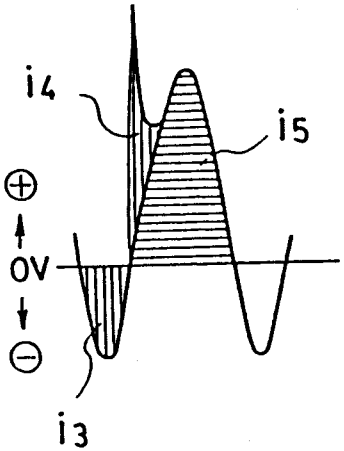

The following description will be made for the function of the embodiment of the present invention constructed as mentioned above. FIG. 5(*a*) shows the current flowing through the generator coil 10 of the present embodiment. At the negative side the charging current $i_6$ flows along the charging path of the generator coil 10 to the diode 28 to the second capacitor 32 to the generator coil 10. After a certain timing, the regulator (−Reg) 36 becomes conductive whereby the short circuit current $i_7$ flows. This certain timing may be adjusted, for example, to occur after fully charging the second capacitor, by detecting the voltage of the generator coil through a zener diode circuit. When the regulator (−Reg) 36 is conductive, the charging current $i_8$ (FIG. 2) runs through the charging path including the second capacitor 32 to the diode 27 to the first capacitor 24 to the ignition coil 30 to the regulator (−Reg) 36 to the second capacitor 32, whereby the first capacitor 24 is charged. Since the charging current i8 is bypassed through the regulator (−Reg) 36, it does not become the current of the generator coil. Following the above, when converting into the positive side the regulator 36 is not conductive and the charging current $i_9$ is run in the charging path including the generator coil 10 to the diode 29 to the diode 27 to the first capacitor 24 to the ignition coil 30 to the generator coil 10 whereby the first capacitor 24 is further charged. After converting into the positive side and after the certain timing, the regulator (+Reg) 34 is conductive and the short circuit current $i_{10}$ flows in the short circuit path including the generator coil 10 to the diode 29 to the regulator (+Reg) 34 to the generator coil 10 so as to take the short circuit condition thereby preparing for the discharge of the discharge path of the first capacitor 24 to the thyristor 38 to the ignition coil 30 to the first capacitor 24. As a result, because the generator coil 10 is short circuited uniformly at the positive and the negative sides, the short circuit current through the generator coil becomes minimum compared with the unequal case. Moreover, since the charging current from the second capacitor 32 to the first capacitor 24 does not flow through the generator coil 10, the short circuit current lessens more than that of the prior voltage doubler ignition device.

Figure 3:
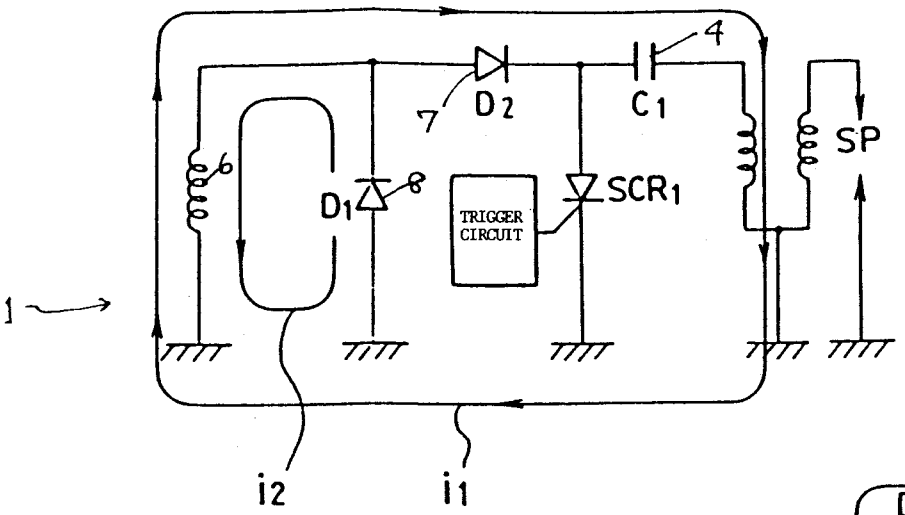
FIG. 3 (PRIOR ART)
FIG. 3 is a circuit diagram showing the prior normal ignition device.
Figure 4:
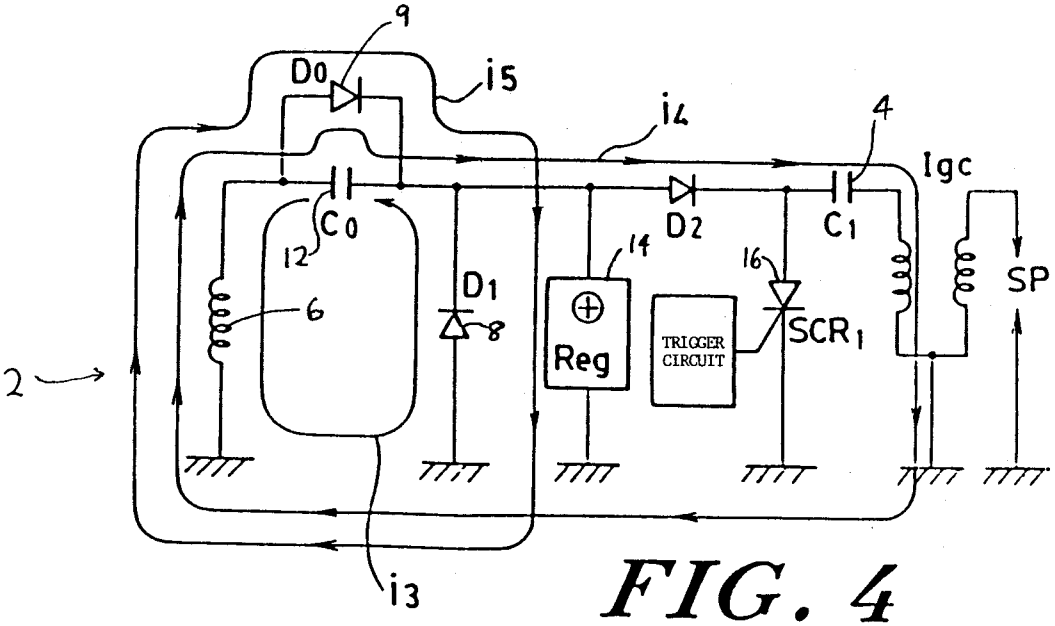
FIG. 4 (PRIOR ART)
FIG. 4 is a circuit diagram showing a prior voltage doubler ignition device.
Figure 6:
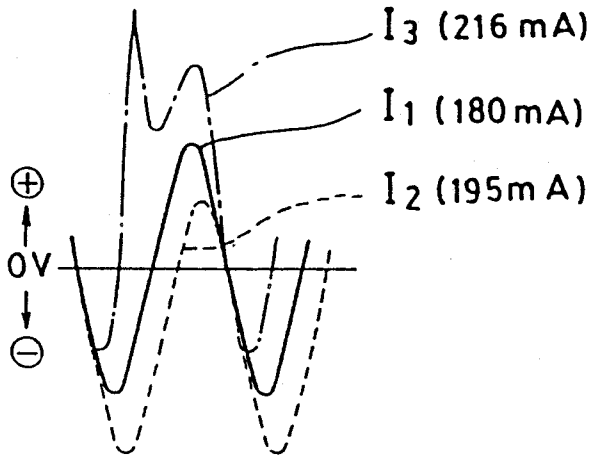
FIG. 6 is a view showing comparison examples of the current values of the generator coils.

FIG. 6 shows comparison examples of current values in the ignition devices according to the present invention and the prior art. In FIG. 6, the effective value of the current $I_2$ of the prior art normal ignition device 1 of FIG. 3 is 195 mA, and the effective value of the current $I_3$ of the prior voltage doubler ignition circuit 2 of FIG. 4 is 216 mA. By contrast, the effective value of the current $T_1$ of the present embodiment is lowered to be 180 mA.

Figure 2:
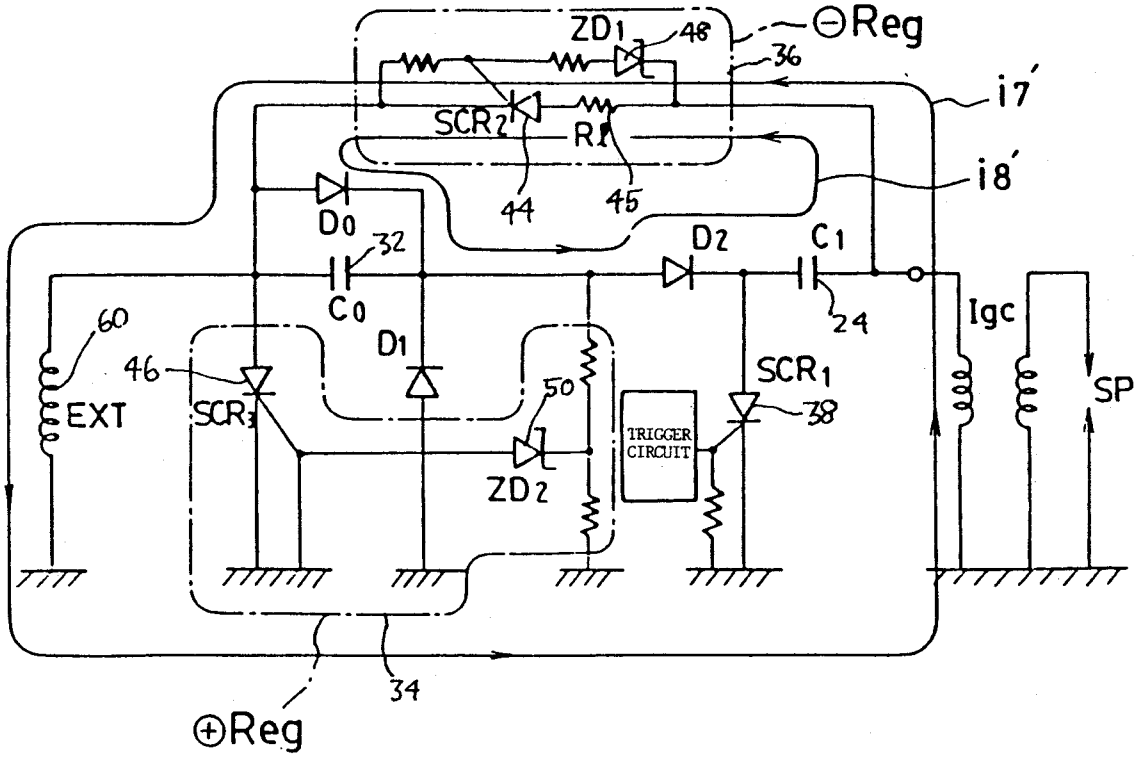
FIG. 2 is a circuit diagram showing another embodiment of the present invention.

FIG. 2 is a circuit diagram showing another embodiment of the present invention. Regulators (+Reg) 34, (−Reg) 36 are constructed by thyristors 44, 46, respectively. The regulators are conductive when the voltage of the generator coil has reached to the required value by voltage detection circuits constituted by zener diodes 48, 50 connected with the gates of the thyristors. Although the regulator (−Reg) 36 differs from that of the embodiment of FIG. 1 in its connecting position, the generator coil 60 is short circuited (short circuit current $i_7'$) at the negative side and it has the same function in charging from the second capacitor 32 to the fist capacitor 24 (charging current $i_8'$). Connected in series with the thyristor 44 of the regulator (−Reg) 36 is a limiting resistor 45 which limits the peak value of the charging current upon activation of the regulator 36, and which protects the thyristor ($SCR_2$) 44. The resistor 45 may be replaced by an inductive load (inductance L), however, in this case, the resistor 45 is preferable because of not generating heat.

As mentioned above, since the present invention makes it possible to reduce the generation of heat in the generator coil, it has an effect that the life time of the generator coil is extended even in engines under high temperature conditions and serves to improve reliability. Also, it is very effective as means in a case that the generation of heat is high in the prior ignition device and that the risk is caused to exceed the upper limits of the windings of the generator coil and the oil.

The invention being thus disclosed, variations and modifications thereof will occur to those skilled in the art, and are within the scope of the invention as defined by the following claims.

What is claimed is:

1. A capacitive discharge ignition device wherein alternating electric power generated by a generator coil is discharged to an ignition coil by a switching element after charging the alternating electric power in a first capacitor to provide an electric spark for igniting an engine characterized in that the device comprises first bypass means for charging a second capacitor during one half cycle of the alternate electric power and for bringing said generator coil to a short circuit or substantially short circuit condition after charging, and for charging said first capacitor from said second capacitor, and second bypass means for charging said first capacitor from said generator coil during the other half cycle of the alternating electric power and for bringing said generator coil to the short circuit or substantially short circuit condition.

2. An ignition device according to claim 1, further including means for controlling said first and second bypass means such that charging currents drawn from the generator coil during two half cycles are substantially equal.

3. An ignition device according to claim 2, wherein the means for controlling includes a voltage sensing element for detecting when the generator reaches a threshold voltage selected to correspond to a charged condition of a said capicitor.

* * * * *

UNITED STATES PATENT AND TRADEMARK OFFICE

CERTIFICATE OF CORRECTION

PATENT NO. : 4,719,896

DATED : January 19, 1988

INVENTOR(S) : Hitoshi Nakayama et al.

It is certified that error appears in the above-identified patent and that said Letters Patent is hereby corrected as shown below:

Column 4, line 62, replace "$T_1$" with --$I_1$--.

Signed and Sealed this

Twenty-second Day of November, 1988

*Attest:*

*Attesting Officer*

DONALD J. QUIGG

*Commissioner of Patents and Trademarks*